United States Patent [19]

Lawrence et al.

[11] Patent Number: 4,920,990

[45] Date of Patent: May 1, 1990

[54] CIGARETTE

[75] Inventors: Brian M. Lawrence; Robert F. Moates; Thomas A. Perfetti, all of Winston-Salem; Renee M. Pogrow, Clemmons; Robert H. Powell, Colfax; Jerry W. Redding; Cynthia A. Stewart, both of Lexington; Karen M. Womble; Milly M. L. Wong, both of Winston-Salem, all of N.C.

[73] Assignee: R. J. Reynolds Tobacco Company, Winston-Salem, N.C.

[21] Appl. No.: 276,161

[22] Filed: Nov. 23, 1988

[51] Int. Cl.[5] ..... A24B 15/00

[52] U.S. Cl. ..... 131/359; 131/360; 131/365

[58] Field of Search ..... 131/365, 336, 335, 359, 131/361

[56] References Cited

U.S. PATENT DOCUMENTS

| | | | |
|---|---|---|---|
| 3,109,436 | 11/1963 | Bavley et al. | 131/17 |
| 3,280,823 | 10/1966 | Bavley et al. | 131/10 |
| 3,422,819 | 1/1969 | Jones et al. | 131/15 |
| 3,584,630 | 6/1971 | Inskeep | 131/9 |
| 3,608,560 | 9/1971 | Briskin | 131/2 |
| 3,834,398 | 9/1974 | Briskin et al. | 131/2 |
| 3,861,400 | 1/1975 | Perkins et al. | 131/2 |
| 3,878,850 | 4/1975 | Gibson et al. | 131/2 |
| 3,885,574 | 5/1975 | Borthwick et al. | 131/2 |
| 3,924,642 | 12/1975 | Eicher et al. | 131/2 |
| 3,924,644 | 12/1975 | Anderson et al. | 131/17 R |
| 3,943,941 | 3/1976 | Boyd et al. | 131/2 |
| 3,993,082 | 11/1976 | Martin et al. | 131/2 |
| 4,079,742 | 3/1978 | Rainer et al. | 131/2 |
| 4,133,317 | 1/1979 | Briskin | 131/2 |
| 4,219,031 | 8/1980 | Rainer et al. | 131/10.5 |
| 4,236,532 | 12/1980 | Schweizer et al. | 131/9 |
| 4,244,381 | 1/1981 | Lendvay | 131/17 A |
| 4,286,604 | 9/1981 | Ehretsmann et al. | 131/359 |
| 4,326,544 | 4/1982 | Hardwick et al. | 131/369 |
| 4,481,958 | 11/1984 | Rainer et al. | 131/331 |
| 4,481,960 | 11/1984 | Brooks | 131/336 |
| 4,596,259 | 6/1986 | White et al. | 131/359 |
| 4,676,259 | 6/1987 | Ellis et al. | 131/335 |
| 4,714,082 | 12/1987 | Banerjee et al. | 131/359 |
| 4,715,389 | 12/1987 | Lynm et al. | 131/335 |
| 4,771,795 | 10/1988 | White et al. | 131/194 |
| 4,830,028 | 5/1989 | Lawson et al. | 131/352 |

FOREIGN PATENT DOCUMENTS

| | | |
|---|---|---|
| 103969 | 3/1984 | European Pat. Off. . |
| 280990 | 9/1988 | European Pat. Off. . |
| 283672 | 9/1988 | European Pat. Off. . |
| 290911 | 11/1988 | European Pat. Off. . |
| 1111007 | 4/1968 | United Kingdom . |
| 1495941 | 12/1977 | United Kingdom . |
| 2094611 | 9/1982 | United Kingdom . |
| 2185175 | 7/1987 | United Kingdom . |

*Primary Examiner*—V. Millin
*Assistant Examiner*—Jennifer L. Doyle

[57] ABSTRACT

Cigarettes have a smokable filler blend comprising 60 to 75 percent tobacco cut filler and 25 to 40 percent of a second smokable cut filler consisting essentially of 50 to 70 percent calcium carbonate, 15 to 45 percent pyrolyzed cotton linters, and 7 to 12 percent polysaccharide binder. The blend is contained in a paper wrapper having a permeability from about 40 to about 75 CORESTA units. Cigarettes normally include a filter element and are air diluted to an air dilution level of from 40 to 65 percent. The smokable blend preferably is blended with a tobacco essence, and the nicotine content of the blend is greater than 2 percent. Cigarettes exhibit resistances to draw between 80 and 150 mm water pressure drop at 17.5 cc/sec. air flow. Cigarettes exhibit FTC "tar" to nicotine ratios less than 9.

29 Claims, 1 Drawing Sheet

CIGARETTE

BACKGROUND OF THE INVENTION

The present invention relates to cigarettes and other such types of smoking articles, and in particular to those cigarettes which deliver good taste and smoking satisfaction while delivering relatively low levels of FTC "tar".

Cigarettes are popular smoking articles which have a substantially cylindrical rod shaped structure and include a charge or roll of tobacco (i e., in cut filler form) surrounded by a wrapper such as paper thereby forming a tobacco rod. Currently, popular cigarettes include blends of tobacco materials, the majority of the blends having nicotine contents in the range from about 1.2 percent to about 2.25 percent, more frequently from about 1.4 percent to about 2 percent, and most frequently from about 1.6 percent to about 1.8 percent, based on the dry weight of the tobacco materials. It has become desirable to manufacture cigarettes having cylindrical filters aligned in an end-to-end relationship with the tobacco rod. Typically, filters are manufactured from fibrous materials such as cellulose acetate and are attached to the tobacco rod using a circumscribing tipping material.

Popular cigarettes classified as "full flavor" cigarettes deliver a desirable tobacco taste, flavor and satisfaction to the smoker. Typically, the "full flavor" cigarettes deliver about 14 mg or more of FTC "tar" per cigarette. A second classification of popular cigarettes is the "full flavor low tar" classification. Typically, the "full flavor low tar" cigarettes deliver from about 8 to about 14 mg of FTC "tar" per cigarette, as well as lower levels of FTC nicotine as compared to "full flavor" cigarettes. A third classification of popular cigarettes is the "ultra low tar" classification. Such "ultra low tar" cigarettes deliver still lower levels of FTC "tar" and nicotine. Typically, the "ultra low tar" cigarettes deliver less than about 7 mg of FTC "tar" per cigarette. The "full flavor low tar" and "ultra low tar" cigarettes conventionally have air dilution means such as laser perforations provided in the periphery of the mouthend region thereof, or have filter elements highly efficient for the removal of "tar" and nicotine from mainstream smoke.

In general, the perceived taste or strength of the cigarettes classified as having lower levels of "tar" and nicotine are progressively less than that of the cigarettes which are classified as approaching the characteristics of the "full flavor" cigarettes. It has been proposed to add certain tobacco extracts to the cut filler of lower "tar" cigarettes to enhance the taste, strength and satisfaction of such cigarettes. However, such addition generally yields mainstream smoke which may be perceived as harsh or irritating to the mouth, nose and throat of the user.

Additionally, it is possible to employ tobaccos having a naturally high nicotine content as cut filler to enhance the tobacco taste, strength and satisfaction of such cigarettes. However, cigarettes having high nicotine contents (e.g., which include tobacco blends having natural nicotine contents above about 2.25 weight percent) generally have the propensity to yield unpalatable mainstream smoke which may be perceived as harsh or irritating to the mouth, nose and throat of the user.

It would be desirable to provide a cigarette such as an "ultra low tar" cigarette which is capable of delivering a good tobacco taste, strength and smoking satisfaction characteristic of a "full flavor low tar" cigarette while being perceived as palatable but not as overly harsh or irritating. In addition, it would be desirable to provide a cigarette such as a "full flavor low tar" cigarette which is capable of delivering a good tobacco taste, strength and smoking satisfaction characteristic of a "full flavor" cigarette while being perceived as palatable but not as overly harsh or irritating.

SUMMARY OF THE INVENTION

The present invention relates to a cigarette which delivers good tobacco taste while being capable of delivering relatively low amounts of FTC "tar". Preferred cigarettes of the present invention deliver taste, strength and smoking satisfaction characteristic of "full flavor" cigarettes, and relatively low levels of FTC "tar" characteristic of "full flavor low tar" cigarettes. Also preferred are cigarettes which deliver taste, strength and smoking satisfaction characteristic of "full flavor low tar" cigarettes, and relatively low levels of FTC "tar" characteristic of "ultra low tar" cigarettes. In addition, the preferred cigarettes are extremely palatable and provide the perception of having smooth smoking character (i.e., not providing a perceived harsh or irritating character) relative to a comparable cigarette delivering similar levels of FTC "tar". Of particular interest are cigarettes having (i) relatively low FTC "tar" to FTC nicotine ratios, (ii) relatively low FTC carbon monoxide to FTC nicotine ratios, (iii) good tobacco flavor, strength and satisfaction, and (iv) a smooth, palatable smoking character without being overly mild tasting. Normally, cigarettes of the present invention exhibit FTC "tar" to FTC nicotine ratios of less than about 9.

The present invention relates to a cigarette having smokable material contained in a circumscribing outer wrapping material, and having a filter element which acts as a mouthpiece. The smokable material is a filler material which includes about 40 to about 85 weight percent tobacco filler material, and about 15 to about 60 weight percent of another (i.e., second) smokable material. The second smokable material normally includes about 40 to about 80 weight percent inorganic material (e.g., calcium carbonate), about 10 to about 50 weight percent of a high carbon content or carbonaceous material (e.g., pyrolyzed alpha-cellulose), and from about 5 to about 15 weight percent binding agent (e.g., carboxymethyl cellulose).

The nicotine content of the cigarette is greater than about 2 percent, preferably greater than 2.25 percent, based on the dry weight of the smokable material.

The cigarette also includes a wrapping material which circumscribes the smokable filler, and which has a permeability from about 5 to about 75 CORESTA units, preferably from about 40 to about 75 CORESTA units, and more preferably from about 50 to about 75 CORESTA units.

A preferred filter element of the cigarette has a low filtration efficiency, usually having a filtration efficiency of less than about 40 percent. See, Keith in Schemeltz's *The Chemistry of Tobacco & Tobacco Smoke,* p. 157 (1972).

The filter element acts to help provide a cigarette which exhibits a resistance to draw between about 50 and about 200 mm water pressure drop at 17.5 cc/sec. air flow.

The cigarette also is air diluted (e.g., by perforating the tipping material in the region which overlies the filter element) so that the cigarette air dilution is between about 25 and about 75 percent.

As used herein, the term "FTC tar" refers to the dry solids collected (i.e., minus nicotine and water) after a cigarette is smoked under FTC smoking conditions. FTC smoking conditions consist of 2 seconds of puffing (35 ml total volume) separated by 58 seconds of smolder. See, Pillsbury et al, *J. Agr. Off. Anal. Chem.*, Vol. 52, Sec. 3, p. 458 (1969).

As used herein, the term "dry weight" in referring to the smokable material of the smoking article is meant the mass of the smokable material after being dried to constant weight at 214° F. (101° C.) for 3 hours in a force-draft oven. See, Moseley et al, *Ind. Eng. Chem.*, Vol. 43, p. 2342 (1951).

As used herein, the term "nicotine content" in referring to the smokable material is meant the mass alkaloid nicotine as analyzed and quantitated by spectroscopic techniques divided by the dry weight of the smokable material analyzed. See, Harvey et al., *Tob. Sci.*, Vol. 25, p. 131 (1981).

As used herein, the term "air dilution" is the ratio (generally expressed as a percentage) of the volume of air drawn through the air dilution means to the total volume of air and smoke drawn through the cigarette and exiting the extreme mouthend portion of the cigarette. See, Selke et al, *Beitr. Zur Tabak. Int.*, Vol. 4, p. 193 (1978).

DETAILED DESCRIPTION OF THE PREFERRED EMBODIMENTS

Figure 1:
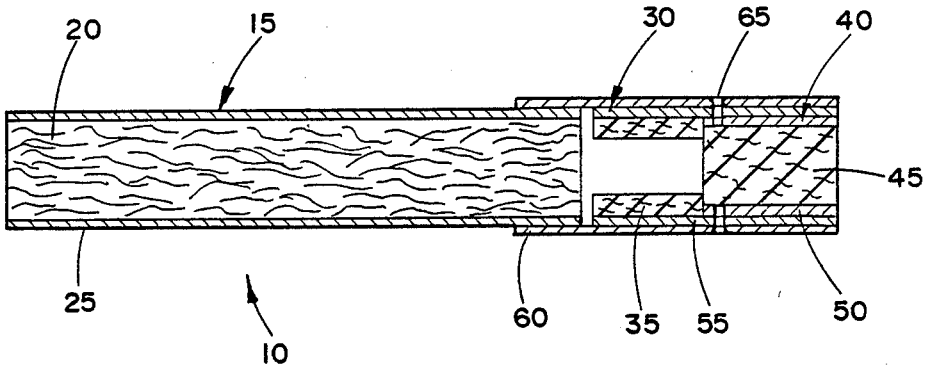
FIGS. 1 and 2 are longitudinal sectional views of cigarettes of this invention.

One embodiment of a cigarette 10 this invention is shown in FIG. 1. The cigarette 10 includes a generally cylindrical rod 15 of smokable material 20, such as cut filler, contained in circumscribing outer wrapping material 25. The rod 15 is hereinafter referred to as a "tobacco rod". The ends of the tobacco rod 15 are open to expose the smokable material. The cigarette 10 also includes a filter element 30 positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough.

The smokable material employed in the manufacture of the tobacco rod can vary. For example, the smokable material of the cigarette can have the form of filler e.g., such as tobacco cut filler). As used herein, the terms "filler" or "cut filler" are meant to include tobacco materials and other smokable materials which have a form suitable for use in the manufacture of tobacco rods for cigarettes. As such, filler can include smokable materials which are blended and are in a form ready for cigarette manufacture. The filler materials normally are employed in the form of strands or shreds as is common in conventional cigarette manufacture. For example, the tobacco cut filler material can be employed in the form of strands or shreds from sheet-like or "strip" materials which are cut into widths ranging from about 1/25 inch to about 1/60 inch, preferably from about 1/30 inch to about 1/40 inch. Generally, such strands or shreds have lengths which range from about 0.25 inch to about 3 inches.

Examples of suitable tobacco materials include flue-cured, Burley, Maryland or Oriental tobaccos, the rare or specialty tobaccos, and blends thereof. The tobacco material can be provided in the form of tobacco lamina; processed tobacco materials such as volume expanded or puffed tobaccos, processed tobacco stems such as cut-rolled or cut-puffed stems, reconstituted tobacco materials; or blends thereof.

Tobacco materials having a naturally high nicotine content often can constitute at least a portion of the smokable filler material useful in manufacturing cigarettes of this invention. Typically, such useful high nicotine content tobaccos or high nicotine content processed tobaccos have nicotine contents of about 2.5 percent or more. The nicotine contents of high nicotine tobacco materials oftentimes are above about 3 percent, and frequently above about 4 percent.

The high nicotine content tobacco materials can vary. For example, tobaccos designated by the U.S.D.A. as Type 35 (One Sucker), Type 36 (Green River) or Type 37 (Virginia Sun Cured) are common tobaccos having a naturally high nicotine content. A cultivar such as *Nicotiana rustica* often has a natural nicotine content in the range of about 6 percent to about 10 percent. Additionally, also useful are upper stalk leaves of commercial lines of flue-cured tobacco (designated by the U.S.D.A. as Types 11–14) and Burley tobacco (designated by the U.S.D.A. as Type 31). The natural nicotine content of many tobaccos can depend upon the agronomic conditions under which the tobaccos are grown as well as the particular genetic line of the tobacco.

Processed tobacco materials can be employed. Such processed tobaccos can be provided using tobacco reconstitution-type processes. For example, materials can be manufactured using extrusion, dry reconstitution, cast sheet, fourdrinier or paper making processes. Raw materials used in manufacturing processed tobaccos can include those high nicotine tobaccos described hereinbefore; or various types of tobacco extracts can be employed in the manufacturing steps of the processed tobaccos. Alternatively, processed tobaccos can be manufactured under conditions suitable to provide products having various nicotine levels. If desired, tobacco extracts can be incorporated into the expansion solvents used to provide a volume expanded processed tobacco material having a high flavor content. A typical expansion process is described in U.S. Pat. No. 3,524,451 to Fredrickson.

High nicotine tobaccos and/or high nicotine processed tobaccos can be employed as the tobacco material of the cigarette, as the components of cigarette blends or as portions of the components of cigarette blends. For example, the high nicotine tobaccos and/or high nicotine processed tobacco materials can be blended with tobacco materials having nicotine contents of less than about 2 percent. Typically, the so-called "American blends" having high nicotine contents (i.e., total blend nicotine contents above about 2 percent) are desirable for cigarette manufacture.

The tobacco material is blended with a second smokable material. The second smokable material includes an inorganic material such as finely divided calcium carbonate, calcium sulfate, attapulgite clays, bentonite clays, or the like. Preferably, the inorganic material is a material which does not burn or change state to any significant degree at those conditions experienced during use of the cigarette. As such, the inorganic material does not tend to provide an undesirable off-taste to the mainstream cigarette smoke during use of the cigarette. The second smokable material also includes a carbonaceous material such as a carbonized or pyrolyzed organic material having a high alpha-cellulose content (i.e., an alpha-cellulose content greater than about 80 weight percent). For purposes of this invention, the term "carbonaceous" means consisting primarily of carbon. Preferred carbonaceous materials include about 80 weight percent carbon, or more. The second smokable material also includes a binding agent such as a polysaccharide binder. Typically, the second smokable material is provided by forming a slurry of the components, casting the slurry as a sheet, and drying the cast material to form a relatively dry sheet. Alternatively, a smokable material having a tobacco character is provided by forming a slurry of the components with a tobacco material such as tobacco dust or a tobacco extract, casting the slurry as a sheet, and drying the cast material to form a relatively dry sheet. Flavors such as menthol can be incorporated into the smokable material by adding the flavor to the slurry during the manufacture of the smokable material if desired.

Normally, the second smokable materials include about 40 to about 80, preferably about 50 to about 70 weight percent inorganic material; about 10 to about 50, preferably about 15 to about 45 weight percent carbonaceous material; and about 5 to about 15, preferably about 7 to about 12 weight percent binding agent.

Smokable materials can be cased and top dressed as is conventionally performed during various stages of cigarette manufacture. For example, additives such as flavoring agents and humectants can be applied to the smokable material as is commonly done when cigarettes are manufactured. Suitable additives include vanillin, cocoa, licorice, menthol, and the like. Flavor modifying agents such as levulinic acid can be applied to the smokable material (e.g., in amounts ranging from about 0.01 to about 2 percent, normally from about 0.1 to about 1 percent, preferably about 0.2 to about 0.6 percent, based on the dry weight of the smokable material). Such additives conveniently are applied to the smokable material as casing and top dressing components.

Smokable materials are mixed, blended or otherwise treated with tobacco in the form of tobacco extracts such as tobacco essences, spray dried tobacco extracts, tobacco aroma oils, or the like. Tobacco materials in the form of tobacco extracts can be applied to the smokable materials as casing components. Alternatively, it is desirable to incorporate tobacco extracts in amounts up to about 60 weight percent, normally up to about 40 weight percent, with the components of the second filler material during the preparation of such a material in order to provide a smokable material having non-tobacco components and a tobacco character. As such, the smokable materials normally have moderately high nicotine contents upon completion of the processing steps involved in their preparation or manufacture, and prior to their use in the manufacture of cigarettes.

Typical total nicotine contents of the blends of smokable materials from which tobacco rods for cigarettes of this invention are manufactured are greater than about 2 percent, generally greater than about 2.25 percent, and preferably greater than 2.5 percent. Normally, the nicotine contents of blends of smokable materials do not exceed about 4 percent, and generally are less than about 3 percent.

Typically, the tobacco rod 15 has a length which ranges from about 50 mm to about 85 mm, preferably about 55 to about 70 mm; and a circumference of about 17 mm to about 27 mm, preferably about 22.5 mm to about 25 mm. Suitable wrapping materials are cigarette wrapping papers commercially available as Reference Nos. 719 and 856 from Kimberly-Clark Corp.; or as Ecusta Reference No. 12710 and Experimental Nos. TOD 03978 and 04158 from Ecusta Corp. The tobacco rods and the resulting cigarettes can be manufactured in any known configuration using known cigarette making techniques and equipment.

The packing densities of the blend of smokable materials contained within the outer wrapping material can vary. Typical packing densities for tobacco rods of cigarettes of this invention range from about 220 to about 350 mg/cm$^3$, preferably about 240 to about 300 mg/cm$^3$, more preferably about 250 to about 280 mg/cm$^3$.

A preferred filter element 30 has two segments or portions. One segment 35 has a generally tubular shape and provides a very low, minimal or essentially no filtration efficiency. Segment 35 can be manufactured from highly plasticized cellulose acetate, a thermoplastic material, or the like; and is positioned in an axially aligned, abutting, end-to-end relationship with the tobacco rod 15. At the other end of tubular segment 35, and in an abutting axially aligned end-to-end relationship therewith, is positioned a second mouthend segment 40. The second segment includes filter material 45 which is overwrapped along the longitudinally extending surface thereof with circumscribing plug wrap material 50. The second segment is manufactured from cellulose acetate tow, polypropylene tow, or the like; and provides for a desirably high resistance to draw. The filter element can carry or contain flavor additives such as tobacco extracts, menthol, spearmint, vanillin, or the like. Plug wrap 55 circumscribes both filter segments.

The filter element 30 is attached to the tobacco rod 15 by tipping material 60 which circumscribes both the entire length of the filter element and an adjacent region of the tobacco rod. The inner surface of the tipping material 60 is fixedly secured to the outer surface of the plug wrap 55 and the outer surface of the wrapping material 25 of the tobacco rod, using a suitable adhesive. A ventilated or air diluted cigarette is provided with an air dilution means such as a series of perforations 65 which extend through the tipping material and plug wrap.

Typically, the filter element has a length which ranges from about 15 mm to about 35 mm, preferably about 25 mm to about 30 mm; and a circumference of about 17 mm to about 27 mm, preferably about 22.5 mm to about 25 mm. Filter materials having compositions or characteristics so as to exhibit low nicotine filtration efficiencies can be employed. The plug wrap typically is a conventional paper plug wrap, and can be either air permeable or essentially air impermeable. However, if desired, nonwrapped cellulose acetate filter elements can be employed to provide the various segments. The various filter element segments suitable for use in this invention can be manufactured using known cigarette filter making techniques and equipment.

Preferred filter elements provide minimal mainstream smoke removal efficiencies while maintaining the desirable draw characteristics of the cigarette. Such minimal smoke removal efficiencies are provided by the so-called "low efficiency" filter elements. Low efficiency filter elements have a minimal ability to remove mainstream smoke particulates. Generally, low efficiency filter elements provide less than about 40 weight percent mainstream smoke particulate removal efficiency. The low efficiency filter element is desirably used herein in order that the relatively low "tar" yield is obtained primarily as a result of a relatively high level of filter ventilation or air dilution. Such cigarette configurations provide a means for reducing the yields of mainstream gaseous components.

Normally, the filter element includes two segments, a generally tubular segment having a very low filtration efficiency and a filter segment capable of providing a relatively high resistance to draw. As such, the filter element, as a whole, can provide a balance of low filtration efficiency and desirably high resistance to draw. Normally, the filter segment is composed of a material having a relatively high filtration efficiency (and hence provide a relatively high resistance to draw), while the relatively short length of the segment provides for a filter element having an overall low filtration efficiency. The length of the tubular (i.e., very low filtration efficiency) segment can vary, and normally ranges from about 5 mm to about 30 mm, preferably about 10 mm to about 20 mm. The length of the filter (i.e., high pressure drop) segment can vary, and normally ranges from about 5 mm to about 30 mm, preferably about 10 mm to about 20 mm.

Typically, the tipping material circumscribes the filter element and an adjacent region of the tobacco rod such that the tipping material extends about 3 mm to about 6 mm along the length of the tobacco rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

For air diluted or ventilated cigarettes of this invention, the amount of air dilution can vary. Preferably, the amount of air dilution for a cigarette is greater than about 25 percent, more preferably greater than about 40 percent. The upper limit of air dilution for a cigarette typically is less than about 75 percent, more frequently less than about 65 percent.

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180, more preferably about 80 to about 150 mm water pressure drop at 17.5 cc/sec. air flow.

Figure 2:
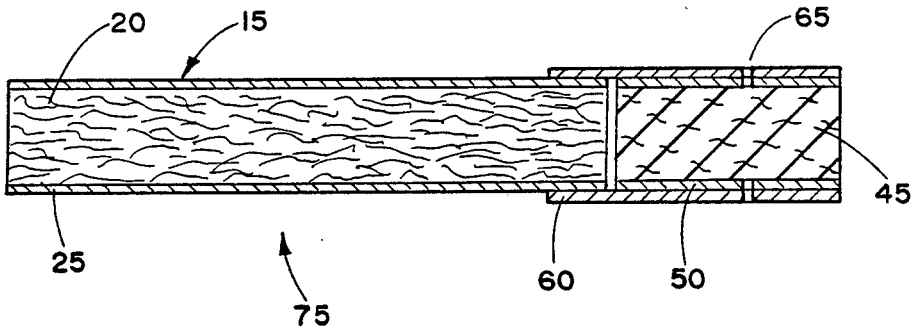

Referring to FIG. 2, cigarette 75 is similar to the cigarette 10 shown in FIG. 1, except that the filter element 30 of cigarette 75 comprises one segment of filter material 45 circumscribed by plug wrap material 50. The filter element 30 of cigarette 75 is axially aligned with the tobacco rod 15 in an abutting, end-to-end relationship.

Cigarettes of this invention generally deliver from about 0.2 mg to about 3.5 mg, frequently from about 0.3 mg to about 2.5 mg, more frequently from about 0.6 mg to about 1.7 mg of nicotine when smoked under FTC conditions. Normally, cigarettes of this invention deliver less than about 14 mg, preferably less than about 10 mg, more preferably less than about 7 mg of "tar" when smoked under FTC conditions. Typically, FTC "tar" to FTC nicotine ratios for cigarettes of this invention generally are less than about 9, frequently less than about 7, and in certain instances less than about 5. FTC "tar" to FTC nicotine ratios for cigarettes of this invention often can range from about 4 to about 7. Typically, FTC carbon monoxide to FTC "tar" ratios for cigarettes of this invention are less than about 1.3, preferably less than about 1.1.

The following examples are provided in order to further illustrate the invention but should not be construed as limiting the scope thereof. Unless otherwise noted, all parts and percentages are by weight.

EXAMPLE 1

A cigarette substantially as shown in FIG. 1 is prepared as follows:

Cigarettes having lengths of 84 mm and circumferences of 24.85 mm have tobacco rod lengths of 57 mm and filter element lengths of 27 mm.

The filter element includes two segments. One segment is a 12 mm length of a plasticized cellulose acetate tube sold commercially as SCS-1 (Ref. No. VT 0381) by American Filtrona Corp. The other segment is a 15 mm length of cellulose acetate tow (2.1 denier per filament; 48,000 total denier) circumscribed by nonporous plug wrap available as Reference No. 646 plug wrap from Ecusta Corp. The two segments are plug-tube combined using Reference No. 646 plug wrap and conventional plug-tube combining equipment. The resulting 27 mm filter element exhibits a filtration efficiency of 38 percent.

A blend of smokable materials is contained in a circumscribing cigarette paper wrap. The wrap is available as Reference No. 12710 from Ecusta Corp. The cigarette paper wrap is a flax/calcium carbonate paper containing 0.5 percent potassium citrate, and exhibits a permeability of about 52 CORESTA units.

The smokable blend is provided as follows: Strip form Burley tobacco lamina (20 parts), strip form flue-cured tobacco lamina (12.7 parts), strip form Oriental tobacco blend (14.7 parts) and strip form reconstituted tobacco from a paper-making process (22.4 parts) is blended with 30.2 parts of another smokable material in strip form consisting essentially of carboxymethyl cellulose, pyrolyzed cotton linters and calcium carbonate. (The other smokable material is described in greater detail hereinafter.) The blend of strip materials is cased such that about 10.7 parts casing is applied to about 89.3 parts of the blend of strip materials. The casing consists essentially of 3.9 parts sugars, 0.76 part licorice, 1.21 part cocoa, 2.15 parts glycerin and 2.7 parts of a Burley tobacco essence. (The essence is described in greater detail hereinafter.) The cased blend of strip materials is cut into cut filler form. The resulting blend of cased cut filler (i.e., 100 parts) is blended with 20.85 parts of a mixture of volume expanded Burley and flue-cured tobacco cut filler. The total nicotine content of the blend is 2.27 percent. The final blend then is equilibrated to a 12.75 percent moisture level before use for cigarette manufacture.

The other smokable material is provided as follows: Cotton linters (i.e., a non-tobacco material) having an alpha-cellulose content greater than 90 percent are heated in a closed oven under nitrogen atmosphere. After about 2.5 hours of heating, the temperature within the oven reaches 1225° F. The temperature within the oven is held at 1225° F for about 1 hour under nitrogen atmosphere. Then, the heating is ceased, the oven is slowly opened, and the temperature within the oven cools to ambient temperature in about 4 hours. The heated (pyrolyzed) cotton linters are black in color and have undergone a weight loss of about 80 percent. Sodium carboxymethyl cellulose available as Aqualon Cellulose Gum from Aqualon Co. and water are mixed in a high shear mixer to produce a viscous liquid. The pyrolyzed cotton linters are folded into the viscous liquid, and then finely divided calcium carbonate is folded into the resulting mixture. The calcium carbonate is available as No. 3050 White 40-200 Calcium Carbonate from Georgia Marble Co. The resulting mixture is a thick slurry having a solid (i.e., carboxymethyl cellulose, pyrolyzed cotton linters and calcium carbonate) content of about 15 percent. The slurry is cast onto a stainless steel sheet and heated to 220° F. to remove moisture. The resulting material is a black sheet having a thickness of about 0.43 mm, a density of about 19.9 g/cm$^3$, and a moisture content of about 15 percent. The sheet has 10 parts carboxymethyl cellulose, 60 parts calcium carbonate and 30 parts pyrolyzed cotton linters. The sheet is cut into strip form, about 2 inches by 3 inches in size.

The tobacco essence is prepared as follows: Aged Burley tobacco in cut filler form is extracted in a stainless steel tank at a concentration of about 1 pound of tobacco per gallon of water. The extraction is conducted at about 20° C while mechanically agitating the mixture over about a 1 hour period. The admixture is centrifuged to remove essentially all suspended solids. The aqueous extract is concentrated in a thin film evaporator to a concentration of about 30 percent dissolved solids while loss of flavorful tobacco volatiles is minimized. The concentrated aqueous extract then is sprayed by continuously pumping the aqueous solution to an Anhydro size No. 1 spray dryer. The inlet temperature of the spray dryer is about 215° C., and the outlet temperature is about 82° C. The spray dried powder is collected at the outlet of the dryer. The powder has a moisture content of about 6 percent. Into a flask is charged 10 g of the spray dried powder and 80 g of ethanol. The flask is sealed and placed in an ultrasonic bath at 20° C. for about 15 minutes. The agitated mixture is filtered through No. 1 quantitative filter paper using a Buchner funnel and a vacuum flask. The filtrate is collected from the vacuum flask, transferred to a 125 ml round bottom flask, and subjected to vacuum treatment (at about 22 inch Hg vacuum in a water bath held at about 60° C.) using a Brinkman Rotovap laboratory rotary evaporator in order to remove essentially all of the ethanol and isolate a residue. The residue or essence is a homogeneous, viscous liquid having a dark reddish-brown color, has a high content of tobacco flavors, and displays a tobacco aroma.

Cigarettes are made using a Protos cigarette maker available from Hauni-Werke Korber & Co. K.G. The filter elements are attached to one end of the tobacco rods using nonporous tipping paper available as Tipping Reference No. 1005856 from Ecusta Corp. The filter elements are positioned relative to the tobacco rods such that the cellulose acetate tube portion of each filter element abuts one end of each tobacco rod. A series of perforations is provided around the periphery of each cigarette about 13 mm from the extreme mouthend of the cigarette using a Hauni 100-watt on-line laser. The resulting cigarettes are 52 percent air diluted. Each cigarette weighs 1.1012 g.

The cigarettes each exhibit a resistance to draw of 130 ml $H_2O$ pressure drop at 17.5 cc/sec. air flow. The cigarettes are employed by burning the tobacco rod such that the cased blend of smokable material within the paper wrapper burns to yield smoke. The cigarettes are smoked under FTC smoking conditions and yield 5.4 mg "tar", 0.63 mg nicotine, and 5.42 mg carbon monoxide per cigarette. Such cigarettes exhibit FTC "tar" to nicotine ratios of 8.6; and FTC carbon monoxide to "tar" ratios of about 1.

EXAMPLE 2

A cigarette substantially as shown in FIG. 1 and as described in Example 1 is provided, except that 86.8 parts of the blend of strip materials is cased with 13.2 parts of a casing consisting essentially of 3.78 parts sugars, 0.75 part licorice, 1.2 part cocoa, 2.1 part glycerin and 5.39 parts of the Burley tobacco essence. The cased blend is blended with 20.85 parts of a mixture of volume expanded Burley and flue-cured tobacco cut filler. The total nicotine content of the blend is 2.36 percent. The final blend then is equilibrated to a 12.75 percent moisture level before use for cigarette manufacture. The resulting cigarette is 50.1 percent air diluted and weighs 1.086 g.

The cigarettes each exhibit a resistance to draw of 130 ml $H_2O$ pressure drop at 17.5 cc/sec. air flow. The cigarettes are smoked under FTC smoking conditions and yield 5.5 mg "tar," 0.72 mg nicotine, and 5.82 mg carbon monoxide per cigarette. Such cigarettes exhibit FTC "tar" to nicotine ratios of 7.6; and FTC carbon monoxide to "tar" ratios of 1.06.

EXAMPLE 3

A cigarette substantially as shown in FIG. 1 and as described in Example 2 is provided, except that the nicotine content of the blend is 2.96 percent. Cigarettes are made using a Hauni Pilot cigarette maker from Hauni-Werke Korber & Co. K.G. The cigarettes are air diluted using a Hauni 100 watt On-Line Lab Laser. The cigarette is about 51 percent air diluted and weighs about 1 g.

The cigarettes each exhibit a resistance to draw to 127 ml $H_2O$ pressure drop at 17.5 cc/sec. air flow. The cigarettes are smoked under FTC conditions and yield 6.4 mg "tar," 0.98 mg nicotine, and 6.6 mg carbon monoxide per cigarette. Such cigarettes exhibit FTC "tar" to nicotine ratios of 6.54; and FTC carbon monoxide to "tar" ratios of 1.03.

EXAMPLE 4

A cigarette substantially as shown in FIG. 2 is prepared as follows:

Cigarettes having lengths of 84 mm and circumferences of 24.85 mm have tobacco rod lengths of 57 mm and filter element lengths of 27 mm.

The filter element includes one segment. The segment is a 27 mm length of cellulose acetate tow (2.7 denier per filament; 48,000 total denier) circumscribed by nonporous plug wrap available as Reference No. 646 plug wrap from Ecusta Corp. The resulting 27 mm filter element exhibits a filtration efficiency of over 50 percent.

A blend of smokable materials is contained in a circumscribing cigarette paper wrap. The wrap is available as Reference No. 856 from Ecusta Corp.

The smokable blend is provided as follows: Strip form Burley tobacco lamina (12.4 parts), strip form flue-cured tobacco lamina (7.9 parts), strip form Oriental tobacco blend (9.2 parts) and strip form reconstituted tobacco from a paper-making process (14.0 parts) is blended with 56.5 parts of another smokable material in strip form consisting essentially of carboxymethyl cellulose, pyrolyzed cotton linters and calcium carbonate. (The other smokable material is described in Example 1.) The blend of strip materials is cased such that 21 parts casing is applied to 79 parts of the blend of strip materials. The casing consists essentially of 6.04 parts sugars, 0.97 part licorice, 1.55 part cocoa, 2.65 parts glycerin and 9.79 parts of a Burley tobacco essence. (The essence is described in Example 1). The cased blend of strip materials is cut into cut filler form. The resulting blend of cased cut filler (i.e., 100 parts) is blended with 11.5 parts of a mixture of volume expanded Burley and flue-cured tobacco cut filler. The total nicotine content of the blend is 3.62 percent. Levulinic acid is added to the total cased blend as a top dressing at about 1 percent of the total blend.

Cigarettes are made using a Hauni Pilot cigarette maker available from Hauni-Werke Korber & Co. K.G. The filter elements are attached to one end of the tobacco rods using nonporous tipping paper available as Tipping Reference No. 1005856 from Ecusta Corp. The filter elements are positioned relative to the tobacco rods such that the cellulose acetate tube portion of each filter element abuts one end of each tobacco rod. A series of perforations is provided around the periphery of each cigarette about 13 mm from the extreme mouthend of the cigarette using a Hauni 100-watt On-Line Lab Laser. The resulting cigarettes are 52 percent air diluted. Each cigarette weighs about 1.1 g.

The cigarettes each exhibit a resistance to draw of 129 ml $H_2O$ pressure drop at 17.5 cc/sec. air flow. The cigarettes are smoked under FTC smoking conditions and yield 5.2 mg "tar," 1.10 mg nicotine, and 6.2 mg carbon monoxide per cigarette. Such cigarettes exhibit FTC "tar" to nicotine ratios of 4.7; and FTC carbon monoxide to "tar" ratios of 1.19.

What is claimed is:

1. A cigarette having smokable material contained in a circumscribing outer wrapping material, the cigarette exhibiting a ratio of FTC "tar" to FTC nicotine of less than 9 and a resistance to draw between 50 and 200 mm water pressure drop at 17.5 cc/sec. air flow; and having:

(a) smokable filler material comprising (i) from about 40 to about 85 weight percent tobacco filler material, and (ii) about 15 to about 60 weight percent of another smokable material having from about 40 to about 80 weight percent inorganic material, from about 10 to about 50 weight percent carbonaceous material, and from about 5 to about 15 weight percent binding agent;

(b) wrapping material circumscribing the smokable filler and having a permeability from about 5 to about 75 CORESTA units;

(c) air dilution between about 25 and about 75 percent; and (d) a nicotine content greater than about 2 percent, based on the dry weight of the smokable material.

2. The cigarette of claim 1 further comprising a filter element which provides a filtration efficiency less than 40 percent.

3. The cigarette of claim 1 having a nicotine content between about 2.5 and about 3 percent, based on the dry weight of the smokable material.

4. The cigarette of claim 2 having a nicotine content between about 2.5 and about 3 percent, based on the dry weight of the smokable material.

5. The cigarette of claim 1, 2, 3 or 4 wherein the smokable filler comprises from about 60 to about 80 weight percent tobacco filler material and from about 20 to about 40 weight percent of the second filler material.

6. The cigarette of claim 1, 2, 3 or 4 wherein the wrapping material has a permeability of about 40 to about 60 CORESTA units.

7. The cigarette of claim 5 wherein the wrapping material has a permeability of about 40 to about 60 CORESTA units.

8. The cigarette of claim 1, 2, 3 or 4 having an air dilution between about 40 and about 60 percent.

9. The cigarette of claim 5 having an air dilution between about 40 and about 60 percent, and the wrapping material has a permeability of about 40 to about 60 CORESTA units.

10. The cigarette of claim 5 having an air dilution between about 40 and about 60 percent.

11. The cigarette of claim 6 having an air dilution between about 40 and about 60 percent.

12. The cigarette of claim 1, 2, 3 or 4 wherein the binding agent of the other smokable material includes a polysaccharide binder.

13. The cigarette of claim 1, 2, 3 or 4 wherein the inorganic material of the other smokable material includes calcium carbonate.

14. The cigarette of claim 12 wherein the inorganic material of the other smokable material includes calcium carbonate.

15. The cigarette of claim 1, 2, 3 or 4 wherein the carbonaceous material includes pyrolyzed alpha-cellulose.

16. The cigarette of claim 12 wherein the carbonaceous material includes pyrolyzed alpha-cellulose.

17. The cigarette of claim 13 wherein the carbonaceous material includes pyrolyzed alpha-cellulose, and the binding agent includes a polysaccharide binder.

18. The cigarette of claim 1, 2, 3 or 4 wherein the cigarette exhibits a resistance to draw of between about 80 and about 150 mm water pressure drop at 17.5 cc/sec. air flow.

19. The cigarette of claim 1, 2, 3 or 4 wherein the ratio of FTC "tar" to FTC nicotine thereof is less than 7.

20. The cigarette of claim 1, 2, 3 or 4 wherein the smokable material includes a tobacco material in the form of an extract.

21. The cigarette of claim 1, 2, 3 or 4 including a levulinic acid additive.

22. The cigarette of claim 21 wherein the amount of levulinic acid present in the cigarette ranges from about 0.1 to about 1 percent, based on the dry weight of the smokable material.

23. The cigarette of claim 1, 2, 3 or 4 which delivers less than about 10 mg "tar" when smoked under FTC conditions.

24. The cigarette of claim 1, 2, 3 or 4 which delivers less than about 7 mg "tar" when smoked under FTC conditions.

25. The cigarette of claim 1, 2, 3 or 4 wherein the smokable filler material comprises (i) from about 60 to about 75 weight percent tobacco filler material, and (ii) about 25 to about 40 weight percent of another smokable filler material having from about 50 to about 70 weight percent inorganic material, from about 15 to about 45 percent carbonaceous material, and from about 7 to about 12 weight percent binding agent.

26. The cigarette of claim 25 wherein the wrapping material has a permeability of about 40 to about 60 CORESTA units.

27. The cigarette of claim 25 having an air dilution between about 40 and about 60 percent.

28. The cigarette of claim 25 having a nicotine content between about 2.5 and about 3 percent, based on the dry weight of the smokable material.

29. The cigarette of claim 25 wherein the ratio of FTC "tar" to FTC nicotine thereof is less than 7.

* * * * *